US010859965B2

(12) United States Patent
Mizutani

(10) Patent No.: US 10,859,965 B2
(45) Date of Patent: Dec. 8, 2020

(54) IMAGE FORMING APPARATUS

(71) Applicant: KYOCERA Document Solutions Inc., Osaka (JP)

(72) Inventor: Naoki Mizutani, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/777,024

(22) Filed: Jan. 30, 2020

(65) Prior Publication Data

US 2020/0257236 A1 Aug. 13, 2020

(30) Foreign Application Priority Data

Feb. 7, 2019 (JP) ..... 2019-020284

(51) Int. Cl.

| | |
|---|---|
| ***G03G 21/10*** | (2006.01) |
| ***G03G 15/16*** | (2006.01) |
| ***G03G 15/08*** | (2006.01) |

(52) U.S. Cl.

CPC ..... *G03G 21/105* (2013.01); *G03G 15/0806* (2013.01); *G03G 15/0865* (2013.01); *G03G 15/16* (2013.01); *G03G 2215/06* (2013.01); *G03G 2215/1623* (2013.01)

(58) Field of Classification Search

CPC .. G03G 21/10; G03G 21/105; G03G 15/0887; G03G 15/0891; G03G 15/0893; G03G 2215/0802; G03G 2215/0827; G03G 2215/0836; G03G 2215/0838

See application file for complete search history.

(56) References Cited

U.S. PATENT DOCUMENTS

2005/0058475 A1* 3/2005 Tsurusaki ..... G03G 21/105 399/358

FOREIGN PATENT DOCUMENTS

JP 2017-032703 A 2/2017

OTHER PUBLICATIONS

JP 2017032703 English machine translation, Yamada et al., Feb. 9, 2017 (Year: 2017).*

* cited by examiner

*Primary Examiner* — Thomas S Giampaolo, II

(74) *Attorney, Agent, or Firm* — Studebaker & Brackett PC

(57) ABSTRACT

An image forming apparatus includes a toner conveyance device and a controller. The toner conveyance device includes a casing, a screw and a film. The casing has a toner conveyance path. The screw rotates in a first rotational direction to convey a toner stored in the toner conveyance path in a predetermined conveyance direction. The film is attached to the screw and rotating together with the screw while coming into contact with an inner face of the toner conveyance path to be elastically deformed. The controller executes a toner conveyance control to rotate the screw and the film in a first rotational direction and a reverse rotation control to rotate the screw and the film in a second rotational direction opposite to the first rotational direction.

11 Claims, 7 Drawing Sheets

IMAGE FORMING APPARATUS

INCORPORATION BY REFERENCE

This application is based on and claims the benefit of priority from Japanese patent application No. 2019-020284 filed on Feb. 7, 2019, which is incorporated by reference in its entirety.

BACKGROUND

The present disclosure relates to an electrophotographic type image forming apparatus.

An electrophotographic type image forming apparatus includes a toner conveyance device in order to convey a toner replenished to a development device or to convey a waste toner collected from an image carrier (for example, a photosensitive drum and an intermediate transferring belt).

For example, the toner conveyance device includes a casing having a toner conveyance path, a screw conveying the toner in the toner conveyance path and a film attached to the screw.

In the above toner conveyance device, the film is rotated together with the screw, and the toner in the toner conveyance path is scraped or loosened. However, if the film continues to rotate in the same direction, the film may be plastically deformed with a bent posture. In such a case, a distance between the rotational center of the screw and the tip end portion of the film may become considerably shorter than that of the fresh film, and the performance of the film may be deteriorated.

SUMMARY

In accordance with an aspect of the present disclosure, an image forming apparatus includes a toner conveyance device and a controller. The toner conveyance device includes a casing, a screw and a film. The casing has a toner conveyance path. The screw rotates in a first rotational direction to convey a toner stored in the toner conveyance path in a predetermined conveyance direction. The film is attached to the screw and rotating together with the screw while coming into contact with an inner face of the toner conveyance path to be elastically deformed. The controller executes a toner conveyance control to rotate the screw and the film in a first rotational direction and a reverse rotation control to rotate the screw and the film in a second rotational direction opposite to the first rotational direction.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, an image forming apparatus 1 according to one embodiment of the present disclosure will be described with reference to the drawings. In each figure, arrows Fr, Rr, L, R, U and Lo respectively show a front side, a rear side, a left side, a right side, an upper side and a lower side of the image forming apparatus 1.

Firstly, an entire structure of the image forming apparatus 1 will be described. The image forming apparatus 1 is a multifunctional peripheral having a printing function, a copying function and a facsimile function totally, for example.

Figure 1:
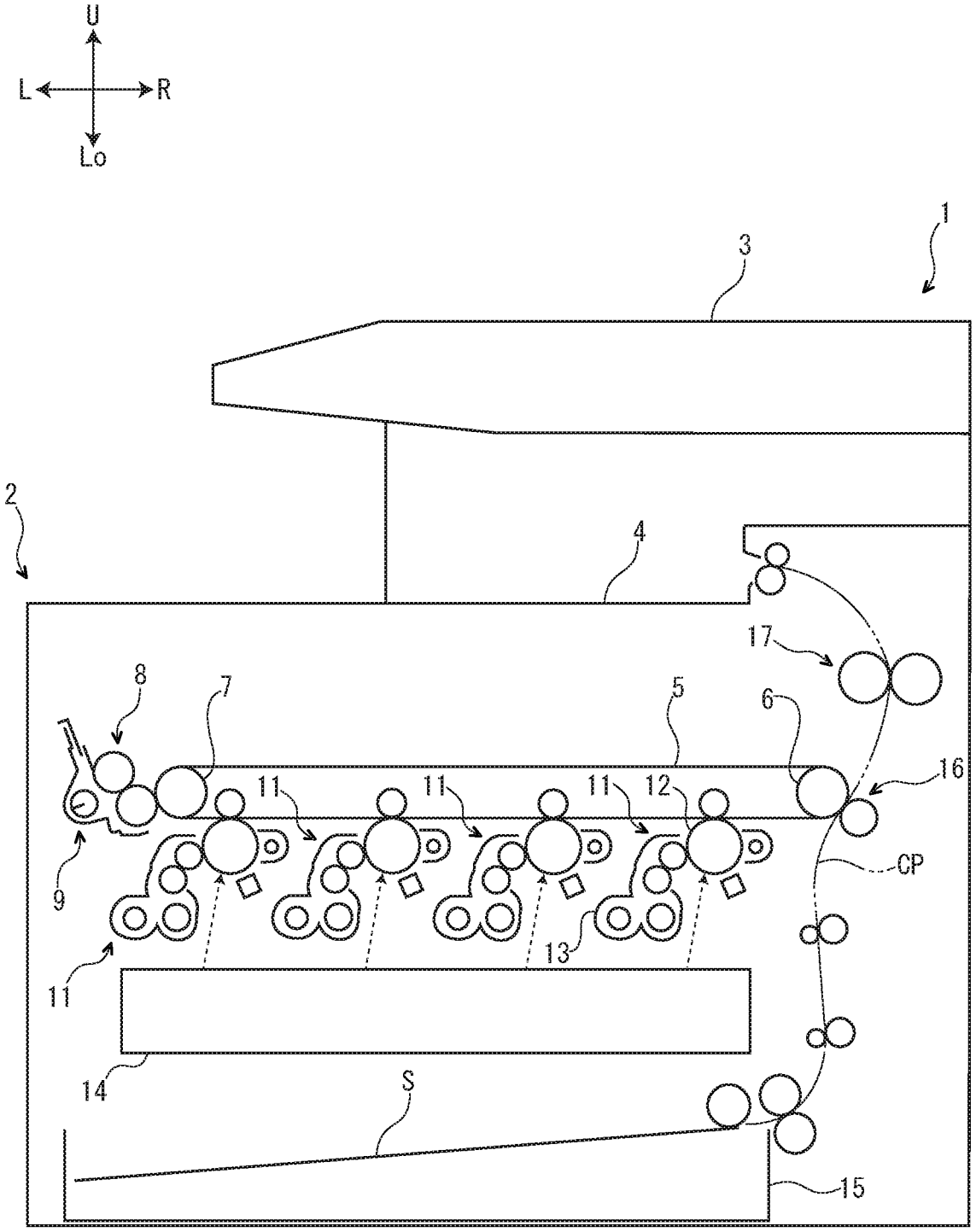
FIG. 1 is a front view schematically showing an image forming apparatus according to one embodiment of the present disclosure.

With reference to FIG. 1, the image forming apparatus 1 includes a box-shaped apparatus main body 2. In the upper end portion of the apparatus main body 2, an image reading device 3 to read an image of a document is provided. In the upper portion of the apparatus main body 2, a discharge tray 4 is provided.

In almost the center portion of the apparatus main body 2, an intermediate transferring belt 5 (an example of an image carrier) is stored. The intermediate transferring belt 5 is wound around a drive roller 6 and a driven roller 7. On a left side of the intermediate transferring belt 5, a cleaning device 8 and a toner conveyance device 9 are provided. In almost the center portion of the apparatus main body 2, four image forming parts 11 are stored below the intermediate transferring belt 5. Each image forming part 11 includes a photosensitive drum 12 and a development device 13.

In the lower portion of the apparatus main body 2, an exposure device 14 is stored. In the lower end portion of the apparatus main body 2, a sheet feeding cassette 15 which stores a sheet S (an example of a recording medium) is stored.

Along the right side portion of the apparatus main body 2, a sheet conveyance path CP is provided from the sheet feeding cassette 15 to the discharge tray 4. In the midstream portion of the sheet conveyance path CP, a secondary transferring part 16 is provided. In the downstream portion of the sheet conveyance path CP, a fixing device 17 is provided.

Next, an example of an operation of the image forming apparatus 1 will be described.

Firstly, the photosensitive drum 12 of each image forming part 11 is exposed with light (refer to a dotted line arrow in FIG. 1) emitted from the exposure device 14, and an electrostatic latent image is formed on the photosensitive drum 12. The electrostatic latent image is developed by the development device 13 of each image forming part 11. Then, a toner image is carried on the photosensitive drum 12 of each image forming part 11. The toner image is primarily transferred to the intermediate transferring belt 5 from the photosensitive drum 12 of each image forming part 11. Then, the toner image is carried on the intermediate transferring belt 5.

On the other hand, the sheet S fed from the sheet feeding cassette 15 is conveyed to the downstream side along the sheet conveyance path CP and then enters the secondary transferring part 16. At the secondary transferring part 16, the toner image is secondarily transferred to the sheet S from the intermediate transferring belt 5. The sheet S on which the toner image is secondarily transferred is conveyed to the downstream side along the sheet conveyance path CP and then enters the fixing device 17. The fixing device 17 fixes the toner image on the sheet S. The sheet S on which the toner image is fixed is discharged on the discharge tray 4.

Next, the cleaning device 8 will be described in detail.

Figure 2:
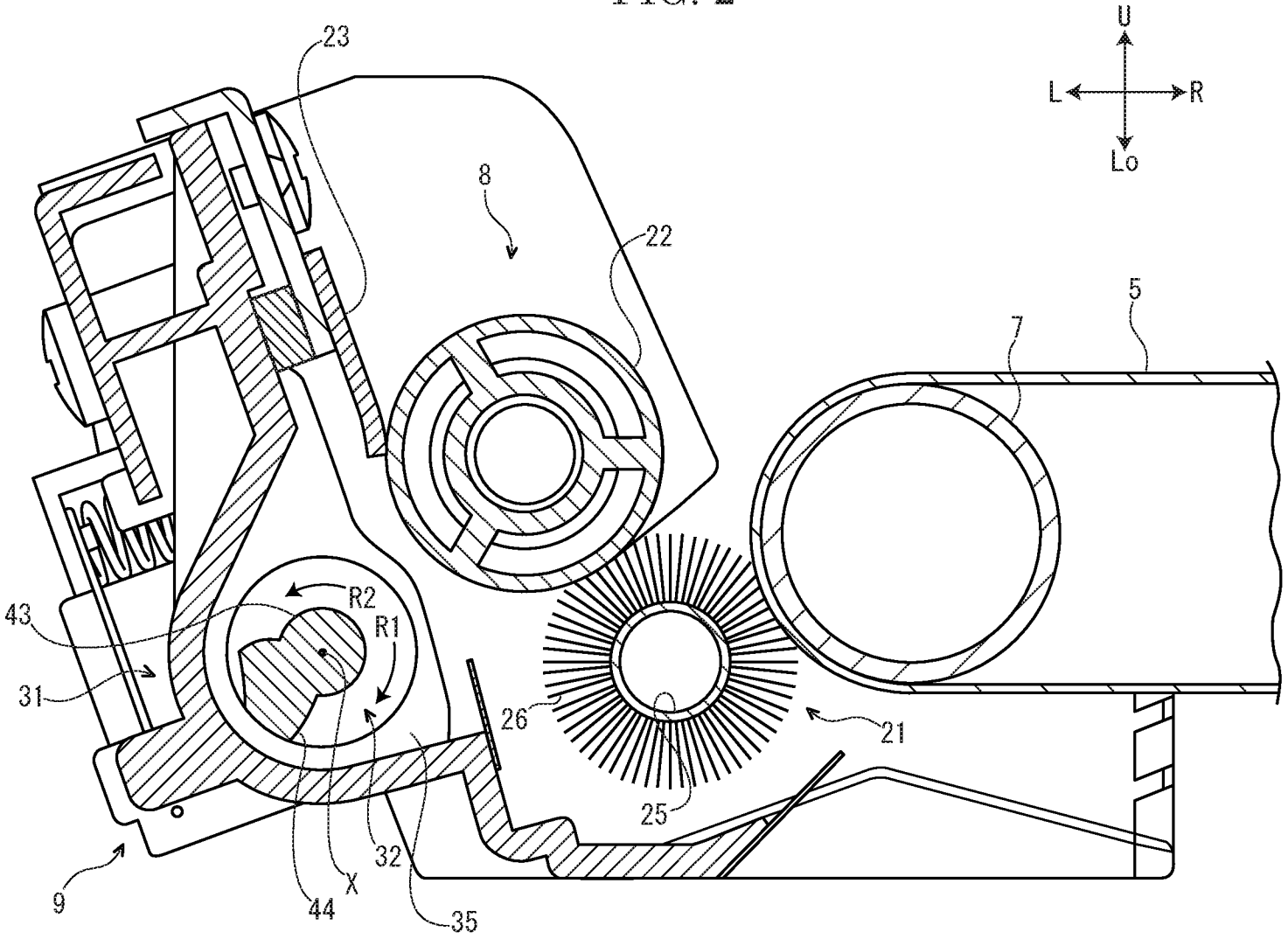
FIG. 2 is a sectional view showing the image forming apparatus according to the embodiment of the present disclosure, on a cross section passing a center portion of a toner conveyance path in the front-and-rear direction.

With reference to FIG. 2, the cleaning device 8 includes a cleaning brush 21, a cleaning roller 22 disposed on a left upper side of the cleaning brush 21 and a cleaning blade 23 disposed on a left upper side of the cleaning roller 22.

The cleaning brush 21 of the cleaning device 8 is rotatable. The cleaning brush 21 has a core metal 25 and a brush bristle 26 provided around the outer circumference of the core metal 25. The core metal 25 is made of metal, for example. The brush bristle 26 is made of resin, for example, and has an electric conductivity. The brush bristle 26 comes into contact with the surface of the intermediate transferring belt 5.

The cleaning roller 22 of the cleaning device 8 is rotatable. The cleaning roller 22 is made of metal, for example. The cleaning roller 22 comes into contact with the brush bristle 26 of the cleaning brush 21.

The cleaning blade 23 of the cleaning device 8 is fixedly provided and is not rotatable. The cleaning blade 23 is made of rubber, foe example. The cleaning blade 23 comes into contact with the cleaning roller 22.

Next, the toner conveyance device 9 will be described in detail.

Figure 3:
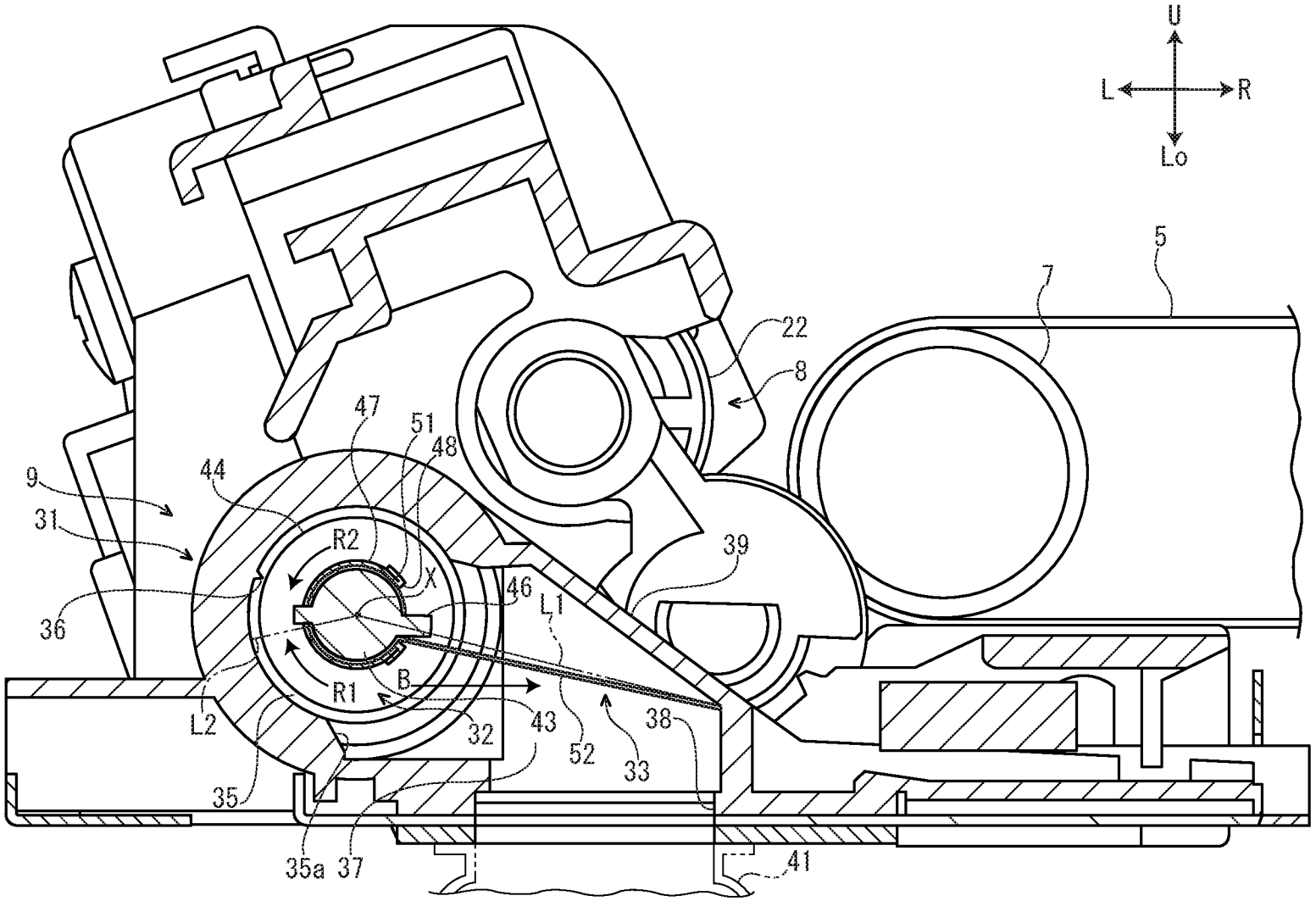
FIG. 3 is a sectional view showing the image forming apparatus according to the embodiment of the present disclosure, on a cross section passing the front end portion of the toner conveyance path in the front-and-rear direction.

With reference to FIG. 3, the toner conveyance device 9 includes a casing 31, a screw 32 stored in the casing 31 and a film 33 attached to the front end portion of the screw 32.

Figure 4:
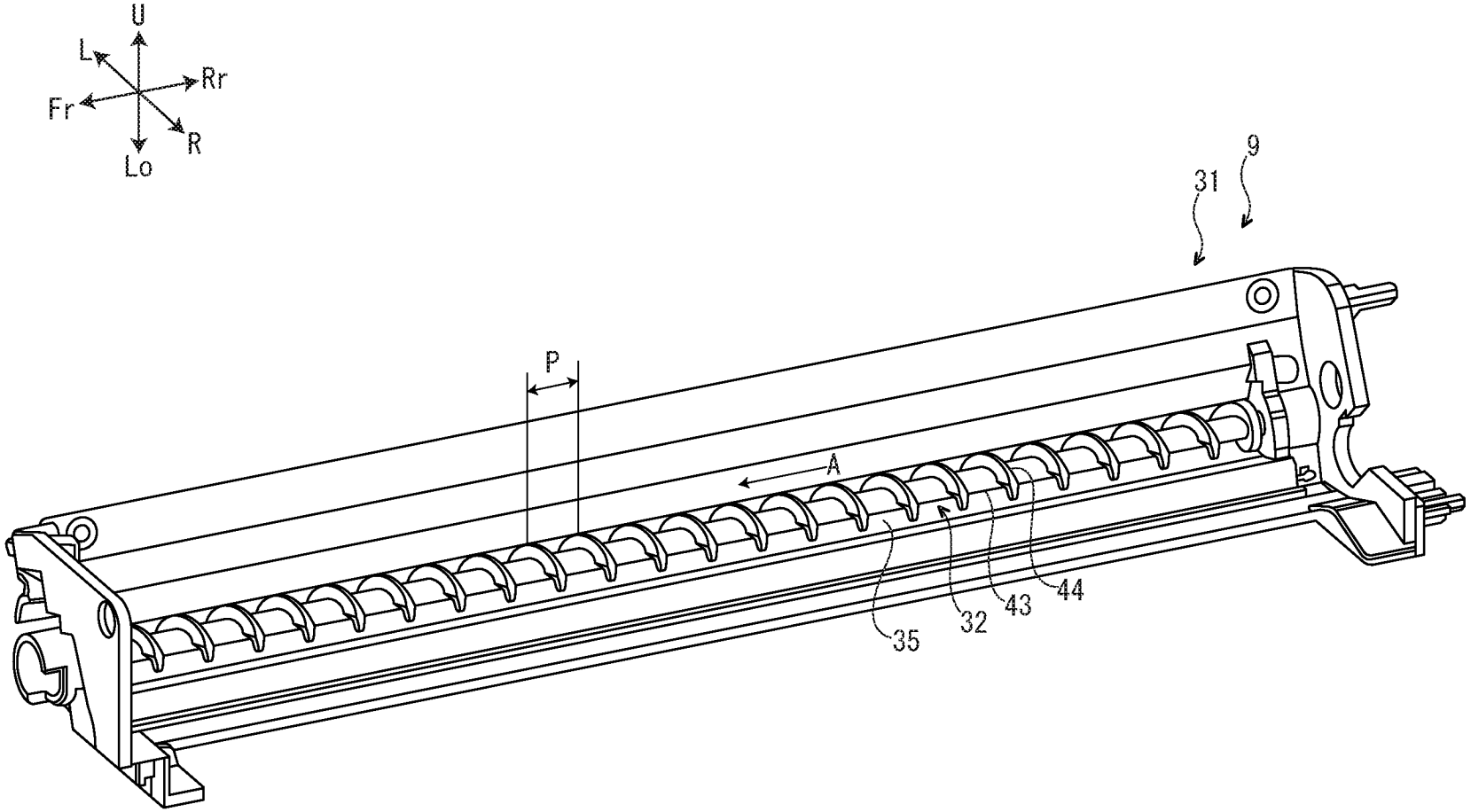
FIG. 4 is a perspective view showing a toner conveyance device according to the embodiment of the present disclosure.

With reference to FIG. 2 to FIG. 4, in the lower portion of the casing 31 of the toner conveyance device 9, a toner conveyance path 35 is provided. The toner conveyance path 35 is formed into a cylindrical shape extending along the front-and-rear direction (an example of one direction). The toner conveyance path 35 except the front end portion is opened to a right side (a side of the cleaning device 8). On the inner face of the front end portion of the toner conveyance path 35, a V-shaped projection 36 (refer to FIG. 3) is formed along the longitudinal direction.

With reference to FIG. 3, in the front end portion of the casing 31, a toner discharge path 37 is provided. The toner discharge path 37 extends along the left-and-right direction (an example of a direction crossing to the one direction) from the front end portion of the toner conveyance path 35. The toner conveyance path 35 and the toner discharge path 37 are communicated with each other via a communication opening 35*a*.

In the front end portion of the casing 31, a toner discharge port 38 is provided below the toner discharge path 37. The toner discharge port 38 is disposed closer to a right side (a side closer to the intermediate transferring belt 5) than the toner conveyance path 35, and is not overlapped with the toner conveyance path 35 in the horizonal direction. Below the toner discharge port 38, a waste toner container 41 is provided. The waste toner container 41 stores a waste toner collected from the surface of the intermediate transferring belt 5 and the surface of the photosensitive drum 12 of each image forming part 11.

In the front end portion of the casing 31, an inclined wall 39 is provided so as to cover the upper space of the toner discharge path 37. The inclined wall 39 is inclined downward toward a right side (a side separate away from the toner conveyance path 35).

With reference to FIG. 2 to FIG. 4, the screw 32 of the toner conveyance device 9 is coaxially stored in the toner conveyance path 35. An arrow A in FIG. 4 shows a toner conveyance direction by the screw 32 (hereinafter, called "a toner conveyance direction").

The screw 32 is rotatable around a rotational axis X extending along the front-and-rear direction. An arrow R1 in each figure shows a clockwise rotational direction around the rotational axis X in a front view (hereinafter, called "a first rotational direction") and an arrow R2 in each figure shows a counterclockwise rotational direction around the rotational axis X in a front view (hereinafter, called "a second rotational direction"). The second rotational direction R2 is opposite to the first rotational direction R1.

The screw 32 includes a shaft 43 extending along the front-and-rear direction and a spiral fin 44 protruding from the outer circumferential face of the shaft 43.

Figure 5:
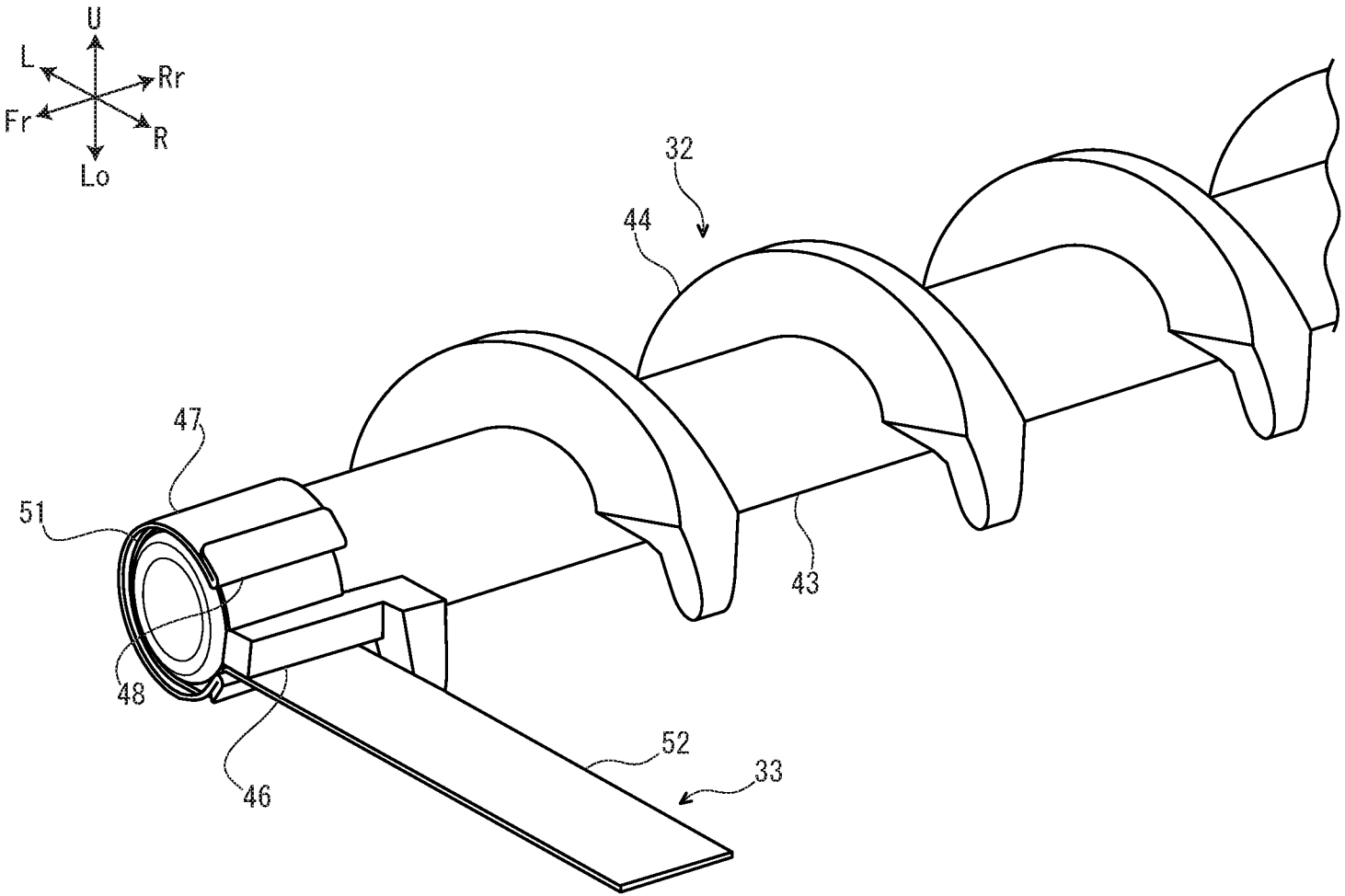
FIG. 5 is a perspective view showing a screw and a film in the toner conveyance device according to the embodiment of the present disclosure.

With reference to FIG. 3 and FIG. 5, on the outer circumferential face of the front end portion of the shaft 43 of the screw 32, a protruding piece 46 is provided. On the outer circumferential face of the front end portion of the shaft 43, a cap 47 having an approximately C-shaped cross section is attached. The cap 47 has a slit 48 extending in the front-and-rear direction. The slit 48 is engaged with the protruding piece 46 of the shaft 43.

With reference to FIG. 4, the fin 44 of the screw 32 is continuously formed from the rear end portion to the front end portion of the screw 32. A pitch P (a width in the front-and-rear direction) of the fin 44 is constant from the rear end portion to the front end portion of the toner conveyance path 35.

With reference to FIG. 3 and FIG. 5, the film 33 of the toner conveyance device 9 is made of resin such as polyethylene terephthalate (PET), for example, and has a flexibility. The film 33 has an attachment part 51 and a scraping part 52 protruding outwardly in the radial direction (to a side separate away from the rotational axis X) from the attachment part 51.

The attachment part 51 of the film 33 is attached on the outer circumferential face of the front end portion of the shaft 43 with held between the front end portion of the outer circumferential face of the shaft 43 and the cap 47. This makes it possible for the film 33 to rotate together with the screw 32 around the rotational axis X.

The scraping part 52 of the film 33 is elastically deformable. The film 33 is elastically deformed in a flat plate posture (refer to FIG. 3) where the scraping part 52 extends straightly in approximately a flat plate shape, a first bent posture (refer to FIG. 6) where the scraping part 52 is bent outwardly in the radial direction (to a side separate away from the rotational axis X) to the upstream side in the first rotational direction R1 along the inner face of the toner conveyance path 35, and a second bent posture (refer to FIG. 7) where the scraping part 52 is bent outwardly in the radial direction to the upstream side in the second rotational direction R2 along the inner face of the toner conveyance path 35

With reference to FIG. 3, when the film 33 is in the flat plate posture, a distance L1 from the rotational axis X to the tip end portion of the scraping part 52 is longer than a distance L2 from the rotational axis X to the inner face of the toner conveyance path 35 (the distance L2 corresponds to an inner radius of the toner conveyance path 35). For example, the distance L1 is twice the distance L2 or longer. When the film 33 is in the flat plate posture, the tip end portion of the scraping part 52 protrudes into the toner discharge path 37 through the communication opening 35*a*, and allows to come into contact with the right end portion of the inclined wall 39 of the casing 31 (the end portion on a side separate away from the toner conveyance path 35).

Next, a control system of the image forming apparatus 1 will be described in detail.

Figure 8:
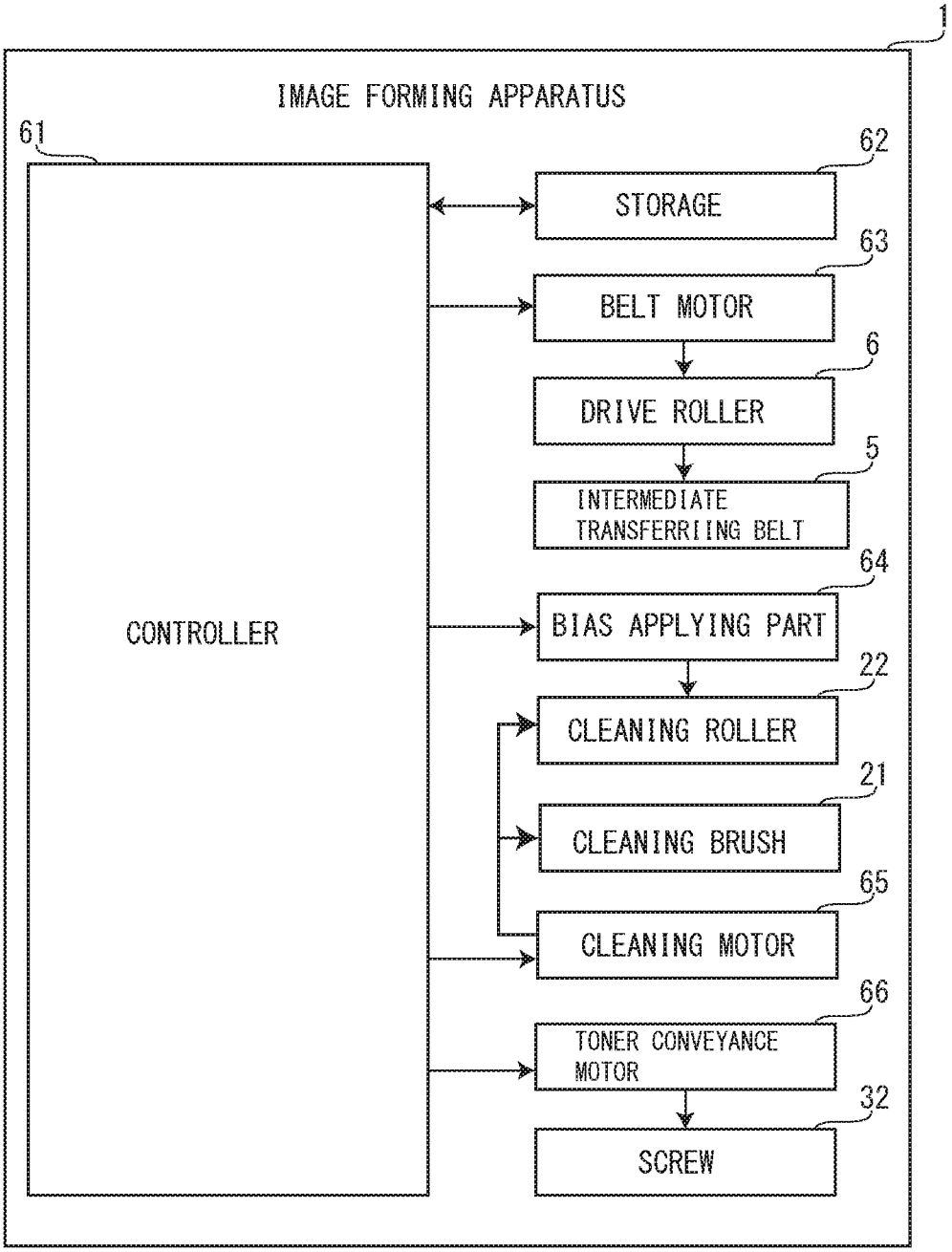
FIG. 8 is a block diagram of a control system of the image forming apparatus according to the embodiment of the present disclosure.

With reference to FIG. 8, the image forming apparatus 1 includes a controller 61. The controller 61 is constituted by a central processing unit (CPU), for example. The controller 61 is connected to each part (for example, the image forming part 11) of the image forming apparatus 1, and controls each part of the image forming apparatus 1.

The controller 61 is connected to a storage 62. The storage 62 stores program and data for control. The storage 62 includes random access memory (RAM) and read only memory (ROM). The storage 62 stores a time T required for the screw 32 to convey the toner from the rear end portion (the upstream side end portion in the toner conveyance direction) to the front end portion (the downstream side end portion in the toner conveyance direction) of the toner conveyance path 35. The time T is calculated by the following formula (1), for example.

$$T=(W/P)\times t \qquad \text{formula (1)}$$

W: a whole length of the screw 32 in the front-and-rear direction,

P: a pitch of the fin 44 of the screw 32, and

T: a time of one rotating of the screw 32.

The controller 61 is connected to a belt motor 63. The belt motor 63 is connected to the drive roller 6. When the belt motor 63 rotates the drive roller 6 based on a signal from the controller 61, the intermediate transferring belt 5 wound around the drive roller 6 is circulated. That is, the belt motor 63 circulates the intermediate transferring belt 5 based on the signal from the controller 61.

The controller 61 is connected to a bias applying part 64. The bias applying part 64 is connected to the cleaning roller 22, and applies a cleaning bias to the cleaning roller 22 based on a signal from the controller 61. The cleaning bias has a polarity opposite to the charge polarity of the toner.

The controller 61 is connected to a cleaning motor 65. The cleaning motor 65 is connected to the cleaning brush 21 and the cleaning roller 22, and rotates the cleaning brush 21 and the cleaning roller 22 based on a signal from the controller 61.

The controller 61 is connected to a toner conveyance motor 66. The toner conveyance motor 66 is normally and reversely rotatable. The toner conveyance motor 66 is connected to the screw 32, and rotates the screw 32 in the first rotational direction R1 or in the second rotational direction R2 based on a signal from the controller 61.

In the image forming apparatus 1 having the above described configuration, after the toner image is secondarily transferred to the sheet S from the intermediate transferring belt 5, the waste toner remains on the surface of the intermediate transferring belt 5. Hereinafter, an operation to collect the waste toner from the surface of the intermediate transferring belt 5 by the cleaning device 8 (hereinafter, called "a waste toner collection operation") will be described.

When the waste toner collection operation is performed, the cleaning motor 65 rotates the cleaning brush 21 and the cleaning roller 22. Additionally, when the waste toner collection operation is performed, the bias applying part 64 applies the cleaning bias to the cleaning roller 22. This produces a potential difference between the cleaning roller 22 and the cleaning brush 21 and a potential difference between the cleaning brush 21 and the surface of the intermediate transferring belt 5.

Under the situation, when the belt motor 63 rotates the intermediate transferring belt 5, the waste toner is transferred from the surface of the intermediate transferring belt 5 to the cleaning brush 21, and then to the cleaning roller 22 from the cleaning brush 21. The waste toner transferred to the cleaning roller 22 is scraped by the cleaning blade 23 from the cleaning roller 22 and then discharged to the toner conveyance path 35. Thus, the waste toner collection operation is finished.

Next, in the image forming apparatus 1 having the above described configuration, an operation to convey the waste toner by the toner conveyance device 9 (hereinafter, called "a waste toner conveyance operation") will be described.

When the waste toner conveyance operation is performed, the toner conveyance motor 66 rotates the screw 32 in the first rotational direction R1. When the screw 32 is thus rotated in the first rotational direction R1, as shown by the arrow A in FIG. 4, the screw 32 conveys the toner in the toner conveyance path 35 in the toner conveyance direction.

Additionally, when the screw 32 is rotated in the first rotational direction R1 as described above, the film 33 is rotated together with the screw 32 in the first rotational direction. When the film 33 is thus rotated in the first rotational direction R1, as shown by an arrow B in FIG. 3, the scraping part 52 of the film 33 scrapes the waste toner in the toner conveyance path 35 toward the toner discharge path 37. The waste toner scraped toward the toner discharge path 37 is introduced in the waste toner container 41 through the toner discharge port 38. Thus, the waste toner conveyance operation is finished.

Figure 6:
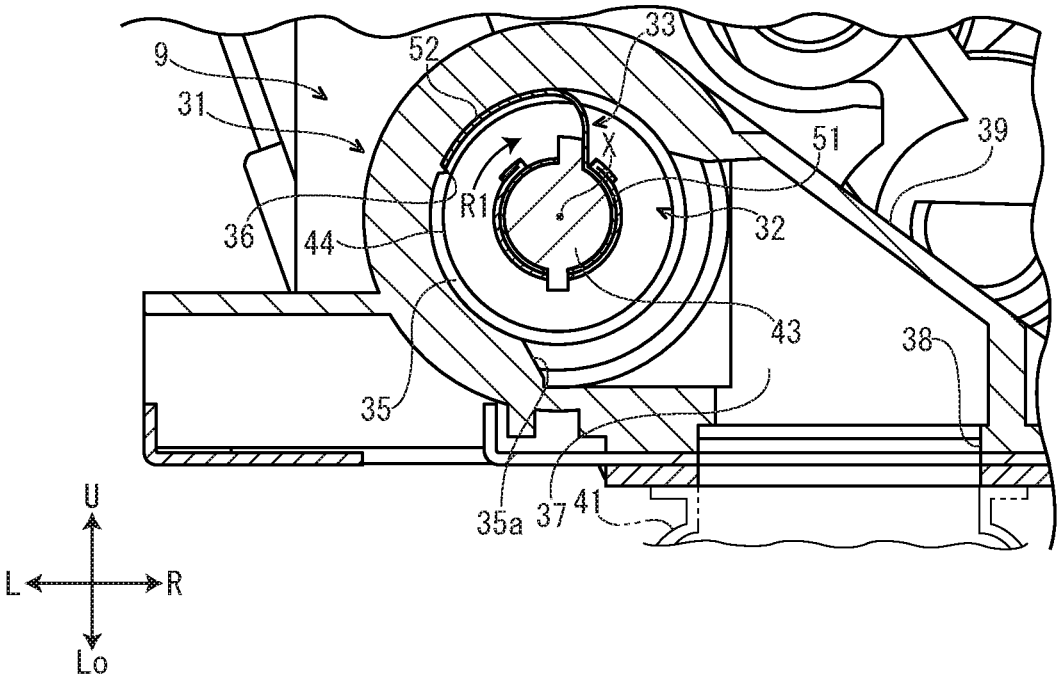
FIG. 6 is a sectional view showing the film in a first bent posture, in the toner conveyance device according to the embodiment of the present disclosure.

By the way, during the above described rotation of the film 33 in the first rotational direction R1, when the tip end portion of the scraping part 52 of the film 33 comes into contact with the inner face of the front end portion of the toner conveyance path 35, the film 33 is deformed into the first bent posture (refer to FIG. 6). On the other hand, during the above described rotation of the film 33 in the first rotational direction R1, when the tip end portion of the scraping part 52 of the film 33 protrudes in the toner discharge path 37 through the communication opening 35*a*, the film 33 is returned to the flat plate posture (refer to FIG. 3). As described above, when the film 33 is rotated in the first rotational direction R1, the film 33 is alternately deformed into the first bent posture and the flat plate posture. Then, the scraping part 52 of the film 33 allows to scrape the waste toner in the toner conveyance path 35 toward the toner discharge path 37.

However, if the film 33 is continuously rotated in the first rotational direction R1 or the film 33 is left with the first bent posture for a long period, the film 33 may be plastically deformed with the first bent posture. If such a situation occurs, the distance L1 from the rotational axis X to the tip end portion of the scraping part 52 of the film 33 becomes remarkably shorter than that of the fresh film 33, and a performance to scrape the waste toner by the scraping part 52 of the film 33 may be deteriorated. Then, the present embodiment inhibits the above failure as described below.

When the image forming operation is performed, the controller 6 executes a waste toner collection control. Specifically, based on a signal from the controller 61, the cleaning motor 65 rotates the cleaning brush 21 and the cleaning roller 22, and the bias applying part 64 applies a cleaning bias to the cleaning roller 22. Then, the above described waste toner collection operation is performed.

Additionally, when the image forming operation is performed, the controller 61 executes a waste toner conveyance control (an example of a toner conveyance control). Specifically, based on a signal from the controller 61, the toner conveyance motor 66 rotates the screw 32 in the first rotational direction R1 to rotate the film 33 together with the screw 32 in the first rotational direction R1. Thus, the above described waste toner conveyance operation is performed.

On the other hand, when the image forming operation is finished, the controller 61 stops the waste toner collection control. Specifically, based on a signal from the controller 61, the cleaning motor 65 stops the rotation of the cleaning brush 21 and the cleaning roller 22, and the bias applying part 64 stops the applying of the cleaning bias to the cleaning roller 22. Thus, the waste toner collection operation is stopped, and the discharging of the toner from the cleaning device 8 to the toner conveyance path 35 is stopped.

Even after the image forming operation is finished and the waste toner collection operation is stopped, the controller 61 continues to execute the waste toner conveyance control for the time T or longer. For example, after the waste toner collection operation is stopped, the controller 61 executes the waste toner conveyance control for the same time as the time T or for twice the time T.

Next, the controller 61 stopes the waste toner conveyance control and a reverse rotation control is performed. Specifically, based on a signal from the controller 61, the toner conveyance motor 66 rotates the screw 32 in the second direction 2 to rotate the film 33 together with the screw 32 in the second rotational direction R2.

Figure 7:
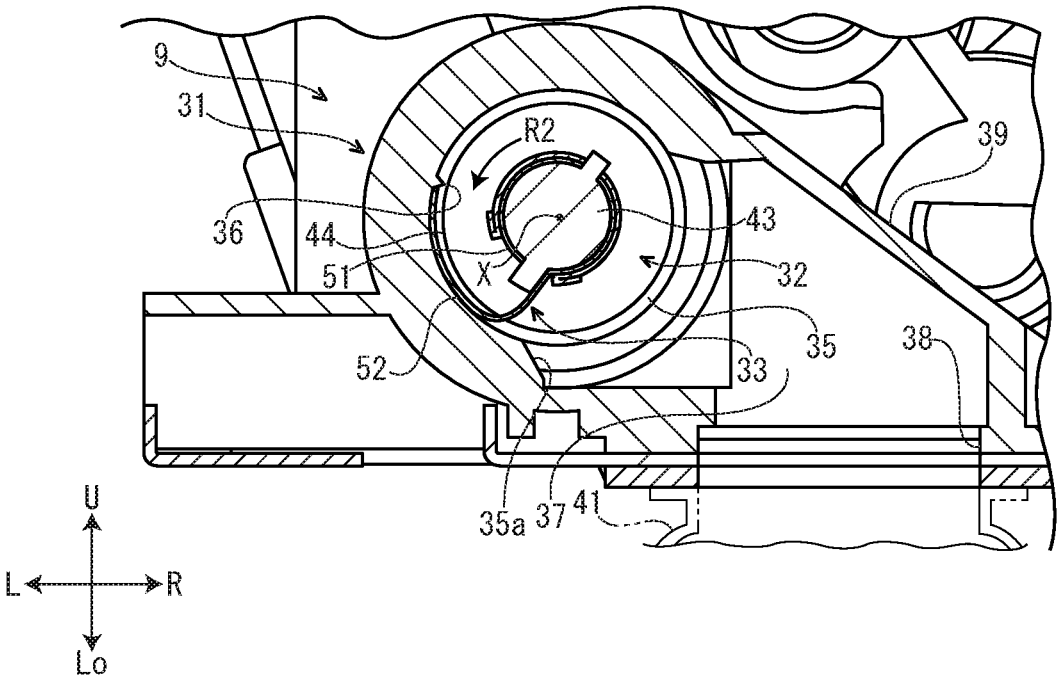
FIG. 7 is a sectional view showing the film in a second bent posture, in the toner conveyance device according to the embodiment of the present disclosure.

During the rotation of the film 33 in the second rotational direction R2, when the tip end portion of the scraping part 52 of the film 33 comes into contact with the inner face of the front end portion of the toner conveyance path 35, the film 33 is deformed in the second bent posture (refer to FIG. 7). On the other hand, during the above described rotation of the film 33 in the second rotational direction R2, when the tip end portion of the scraping part 52 of the film 33 protrudes in the toner discharge path 37, the film 33 is deformed in the flat plate posture (refer to FIG. 3). As described above, when the film 33 is rotated in the second rotational direction R2, the film 33 is alternately deformed into the second bent posture and the flat plate posture.

As described above, the controller 61 executes the waste toner conveyance control to rotate the screw 32 and the film 33 in the first rotational direction R1 and the reverse rotation control to rotate the screw 32 and the film 33 in the second rotational direction R2 opposite to the first rotational direction R1. By the reverse rotation control to rotate the film 33 in the second rotational direction R2, the film 33 takes the second bent posture to inhibit the film 33 from being plastically deformed with the first bent posture. Therefore, it becomes possible to keep a toner scraping performance of the scraping part 52 of the film 33 well for a long period.

At the starting of the reverse rotation control, when the film 33 is rotated in the second rotational direction R2 with the first bent posture, the tip end portion of the scraping part 52 of the film 33 comes into contact with the projection 36 of the toner conveyance path 35 (refer to FIG. 6). Then, the tip end portion of the scraping part 52 of the film 33 is temporarily engaged with the projection 36 of the toner conveyance path 35. As a result, the base end portion of the scraping part 52 of the film 33 is relatively deformed to the downstream side in the second rotational direction R2 with respect to the tip end portion of the scraping part 52 of the film 33, and then the film 33 is deformed from the first bent posture to the second bent posture (refer to FIG. 7). By applying such a configuration, at the starting of the reverse rotation control, it becomes possible to deform the film 33 from the first bent posture to the second bent posture surely.

The controller 61 executes the waste toner conveyance control for the time T or longer and then the reverse rotation control after the discharging of the toner from the cleaning device 8 to the toner conveyance path 35 is stopped. Therefore, it becomes possible to prevent the toner in the toner conveyance path 35 from reversing from the front side to the rear side owing to the execution of the reverse rotation control.

The controller 61 executes the waste toner conveyance control when the image forming operation is performed and the reverse rotation control when the image forming operation is not performed. Therefore, it becomes possible to execute the waste toner conveyance control and the reverse rotation control at a suitable timing and to achieve both an improvement in a waste toner connection efficiency and an inhibition of the plastic deformation of the film 33.

In the present embodiment, the controller 61 executes the reverse rotation control after the completion of the image forming operation. By executing the reverse rotation control at such a timing, it becomes possible to effectively use a free time after the completion of the image forming operation to execute the reverse rotation control.

The controller 61 executes the reverse rotation control every time when the waste toner conveyance control is executed. Therefore, it becomes possible to inhibit the plastic deformation of the film 33 surely.

The casing 31 has the toner discharge path 37 extending along the left-and-right direction from the toner conveyance path 35, and the film 33 scrapes the toner in the toner conveyance path 35 toward the toner discharge path 37. Therefore, it becomes possible to convey the toner in a direction crossing to the rotational axis X by using a simple structure.

The present embodiment applies the configuration of the present disclosure to the toner conveyance device 9 which conveys the waste toner discharged from the cleaning device 8 to the waste toner container 41. Then, it becomes possible to convey the waste toner discharged from the cleaning device 8 to the waste toner container 41 surely.

In the present embodiment, the controller 61 executes the reverse rotation control after the completion of the image forming operation. On the other hand, in another embodiments, the controller 61 may executes the reverse rotation control when power is on. By executing the reverse rotation control at such a timing, it becomes possible to effectivity use a free time at power-on to execute the reverse rotation control. In the still another embodiment, the reverse rotation control may be executed at a waiting time in which the image forming operation is not required.

In the present embodiment, the controller 61 executes the reverse rotation control every time when the waste toner conveyance control is executed. On the other hand, in other embodiments, the controller 61 may execute the reverse rotation control when the waste toner conveyance control is executed for a specific number of times. In this case, the controller 61 accumulates the execution time of the waste toner conveyance control when the waste toner conveyance control is executed for the specific number of times, calculates an accumulated execution time, and then executes the reverse rotation control for the same time as the accumulated execution time, preferably. This makes it possible to inhibit the plastic deformation of the film 33 surely even if the reverse rotation control is not executed every time when the waste toner conveyance control is executed.

In the present embodiment, the toner conveyance path 35 has the projection 36. On the other hand, in other embodiments, the toner conveyance path 35 may not have the projection 36.

In the present embodiment, the toner conveyance device 9 conveys the waste toner discharged from the cleaning device 8 which collects the waste toner remaining on the surface of the intermediate transferring belt 5. On the other hand, in another embodiment, the toner conveyance device 9 may convey the waste toner discharged from a cleaning device (not shown) which collects the waste toner remaining on the surface of the photosensitive drum 12. In still another embodiment, the toner conveyance device 9 may convey the toner replenished to the development device 13. That is, the toner conveyance device 9 may be provided in anywhere in the image forming apparatus 1.

In the present embodiment, the image forming apparatus 1 is a multifunctional peripheral. On the other hand, in another embodiment, the image forming apparatus 1 may be a printer, a copying machine and a facsimile.

The invention claimed is:

1. An image forming apparatus comprising:

a toner conveyance device including a casing having a toner conveyance path, a screw rotating in a first rotational direction to convey a toner stored in the toner conveyance path in a predetermined conveyance direction, and a film attached to the screw and rotating together with the screw while coming into contact with an inner face of the toner conveyance path to be elastically deformed; and a controller executing a toner conveyance control to rotate the screw and the film in a first rotational direction and a reverse rotation control to rotate the screw and the film in a second rotational direction opposite to the first rotational direction, wherein a projection is formed on the inner face of the toner conveyance path, the film is elastically deformable in a first bent posture where the film is bent outwardly in a radial direction to an upstream side in the first rotational direction along the inner face of the toner conveyance path and a second bent posture where the film is bent outwardly in the radial direction to an upstream side in the second rotational direction along the inner face of the toner conveyance path, and at a starting of an execution of the reverse rotation control, when the film is rotated with the first bent posture in the second rotational direction, a tip end portion of the film comes into contact with the projection and then the film is elastically deformed from the first bent posture into the second bent posture.

2. The image forming apparatus according to claim 1, wherein the toner conveyance path is formed into a cylindrical shape, the screw is coaxially disposed in the toner conveyance path, the film is attached to a rotational shaft of the screw so as to protrude in a radial direction of the rotational shaft, and the film has a radial length equal to or longer than twice a radius of the toner conveyance path.

3. The image forming apparatus according to claim 1, wherein the controller executes the toner conveyance control when an image forming operation is performed, and executes the reverse rotation control when the image forming operation is not performed.

4. The image forming apparatus according to claim 1, wherein the controller executes the reverse rotation control after an image forming operation is completed.

5. The image forming apparatus according to claim 1, wherein the controller executes the reverse rotation control when a power is turned on.

6. The image forming apparatus according to claim 1, wherein the controller executes the reverse rotation control every time when the toner conveyance control is executed.

7. The image forming apparatus according to claim 1, wherein the toner conveyance path extends along one direction, the casing includes:

a toner discharge path extending along a direction crossing to the one direction from the toner conveyance path; and a communication opening communicating between the toner discharge path and the toner conveyance path, wherein the film is attached to an end portion of the screw on a side of the communication opening and scrapes the toner in the toner conveyance path toward the toner discharge path through the communication opening.

8. The image forming apparatus according to claim 7, wherein when the film protrudes in the toner discharge path through the communication opening, an elastic deformation of the film is released, the controller controls the screw such that the film protrudes into the toner discharge path through the communication opening during a time when the toner conveyance control and the reverse rotation control are not executed.

9. The image forming apparatus according to claim 1, further comprising:

an image carrier which carries a toner image;

a cleaning device which collects a waste toner from the image carrier; and a waste toner container in which the waste toner collected from the image carrier is stored, wherein the toner conveyance device conveys the waste toner discharged from the cleaning device to the waste toner container.

10. An image forming apparatus, comprising:

a toner conveyance device including a casing having a toner conveyance path, a screw rotating in a first rotational direction to convey a toner stored in the toner conveyance path in a predetermined conveyance direction, and a film attached to the screw and rotating together with the screw while coming into contact with an inner face of the toner conveyance path to be elastically deformed;

a controller executing a toner conveyance control to rotate the screw and the film in a first rotational direction and a reverse rotation control to rotate the screw and the film in a second rotational direction opposite to the first rotational direction;

a discharge device which discharges the toner to the toner conveyance path; and a storage which stores a time required for the screw to convey the toner from an upstream side end portion to a downstream side end portion of the toner conveyance path in the conveyance direction, wherein the controller executes the toner conveyance control for the time or longer and then the reverse rotation control after a discharging of the toner from the discharge device to the toner conveyance path is stopped.

11. An image forming apparatus comprising:

a toner conveyance device including a casing having a toner conveyance path, a screw rotating in a first rotational direction to convey a toner stored in the toner conveyance path in a predetermined conveyance direction, and a film attached to the screw and rotating together with the screw while coming into contact with an inner face of the toner conveyance path to be elastically deformed; and a controller executing a toner conveyance control to rotate the screw and the film in a first rotational direction and a reverse rotation control to rotate the screw and the film in a second rotational direction opposite to the first rotational direction, wherein the controller accumulates an execution time of the toner conveyance control, calculates an accumulated execution time and then executes the reverse rotation control for the same time as the accumulated execution time.

* * * * *